US009052655B2

(12) United States Patent
Son et al.

(10) Patent No.: US 9,052,655 B2
(45) Date of Patent: Jun. 9, 2015

(54) HEATING MEMBER INCLUDING A BASE POLYMER AND FUSING APPARATUS INCLUDING THE SAME

(71) Applicant: Samsung Electronics Co., Ltd., Suwon-Si, Gyeonggi-Do (KR)

(72) Inventors: Yoon-chul Son, Hwaseong-si (KR); Dong-earn Kim, Seoul (KR); Dong-ouk Kim, Pyeongtaek-si (KR); Ha-jin Kim, Hwaseong-si (KR); Sung-hoon Park, Seoul (KR); Min-jong Bae, Yongin-si (KR); Sang-eui Lee, Hwaseong-si (KR); Kun-mo Chu, Seoul (KR); In-taek Han, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 114 days.

(21) Appl. No.: 13/848,195

(22) Filed: Mar. 21, 2013

(65) Prior Publication Data

US 2013/0251425 A1 Sep. 26, 2013

(30) Foreign Application Priority Data

Mar. 23, 2012 (KR) ..... 10-2012-0030229

(51) Int. Cl.

| | |
|---|---|
| ***G03G 15/20*** | (2006.01) |
| ***H05B 3/12*** | (2006.01) |
| ***H05B 3/36*** | (2006.01) |
| ***H05B 3/14*** | (2006.01) |
| ***H05B 3/38*** | (2006.01) |

(52) U.S. Cl.

CPC ..... *G03G 15/2064* (2013.01); *H05B 3/12* (2013.01); *H05B 3/36* (2013.01); *G03G 15/2057* (2013.01); *H05B 3/146* (2013.01); *H05B 3/38* (2013.01)

(58) Field of Classification Search

CPC ..... G03G 15/2057; G03G 15/2064
USPC ..... 399/333, 330
See application file for complete search history.

(56) References Cited

U.S. PATENT DOCUMENTS

| | | | | |
|---|---|---|---|---|
| 5,639,549 | A * | 6/1997 | Fukunaga et al. | |
| 6,408,160 | B1 * | 6/2002 | Saito et al. | 399/333 |
| 6,490,431 | B2 * | 12/2002 | Takahashi et al. | 399/333 |
| 7,024,146 | B2 * | 4/2006 | Kim et al. | 399/330 |
| 8,290,418 | B2 * | 10/2012 | Kim et al. | 399/333 |
| 2007/0181251 | A1 * | 8/2007 | Ikeda et al. | |
| 2009/0233085 | A1 * | 9/2009 | Gervasi et al. | |
| 2010/0189943 | A1 | 7/2010 | Qi et al. | |
| 2011/0129267 | A1 | 6/2011 | Arimoto et al. | |

FOREIGN PATENT DOCUMENTS

| | | | |
|---|---|---|---|
| JP | 2006267436 | A | 10/2006 |
| JP | 2007179009 | A | 7/2007 |
| JP | 2010217218 | A | 9/2010 |

* cited by examiner

*Primary Examiner* — Susan Lee
(74) *Attorney, Agent, or Firm* — Harness, Dickey & Pierce

(57) ABSTRACT

A heating member includes: a resistive heating layer which generates heat when supplied with electrical energy; a release layer as an outermost layer of the heating member and including a polymer; an intermediate layer disposed between the resistive heating layer and the release layer. The resistive heating layer includes a base polymer, and an electroconductive filler dispersed in the base polymer. The intermediate layer includes a polymer material being a same type as the base polymer of the resistive heating layer or the polymer of the release layer.

22 Claims, 7 Drawing Sheets

HEATING MEMBER INCLUDING A BASE POLYMER AND FUSING APPARATUS INCLUDING THE SAME

CROSS-REFERENCE TO RELATED APPLICATIONS

This application claims priority to Korean Patent Application No. 10-2012-0030229, filed on Mar. 23, 2012, and all the benefits accruing therefrom under 35 U.S.C. §119, the disclosure of which is incorporated herein by reference.

BACKGROUND

1. Field

Provided is a heating member using a resistive heater, and a fusing apparatus including the heating member.

2. Description of the Related Art

In an electrophotographic imaging apparatus, an electrostatic latent image formed on an image receptor is supplied with toner to form a visible toner image on the image receptor. After transfer of the toner image onto a recording medium, the toner image is fused onto the recording medium. The toner may be prepared by addition of a variety of functional additives, including a coloring agent, into a base resin. The fusing of the toner image involves applying heat and pressure. Energy used in the fusing process makes up most of a total amount of energy used in the electrophotographic imaging apparatus.

In general, a fusing apparatus includes a heat roller and a press roller engaging each other to form a fusing nip. The heat roller is heated by a heat source, such as a halogen lamp. While the recording medium with the transferred toner image passes through the fusing nip, heat and pressure are applied to the toner. In such a fusing apparatus, sequential heat transfer from the heat source to the toner via the heat roller and the recording medium is unlikely to lead to a high heat transfer efficiency. Furthermore, high thermal capacity of the heat roller is disadvantageous in view of a high temperature rise rate of the heat roller.

To address these drawbacks, there has been suggested a fusing apparatus with a sheet heater using hot wires on an external surface of a heat roller. Though the sheet heater is advantageous in terms of a high temperature rise rate, the whole body thereof is unlikely to be uniformly heated. That is, the sheet heater may be locally overheated near hot wires.

SUMMARY

Provided are a heating member with ensured durability and electrical stability, and a fusing apparatus including the heating member.

Additional aspects will be set forth in part in the description which follows and, in part, will be apparent from the description, or may be learned by practice of the presented embodiments.

Provided is a heating member including: a resistive heating layer which generates heat when supplied with electrical energy; a release layer as an outermost layer of the heating member and including a polymer; and an intermediate layer disposed between the resistive heating layer and the release layer. The resistive heating layer includes a base polymer, and an electroconductive filler dispersed in the base polymer. The intermediate layer includes a polymer material being a same type as the base polymer of the resistive heating layer or the polymer of the release layer.

The intermediate layer may be an elastic layer.

Adhesion between the intermediate layer and the release layer may be about 300 newtons per meter (N/m) or greater.

The intermediate layer may have a thermal conductivity of about 0.5 watt per meter per Kelvin (W/m·K) or greater.

The intermediate layer may be substantially a non-electroconductive layer.

The intermediate layer may include about 30 wt % or more of thermal conducting particles, and the thermal conducting particles may include at least one of alumina, zinc oxide and metal silicon.

The intermediate layer may include at least one of a silicon-based polymer and a fluoropolymer.

The base polymer may include at least one of a silicon-based polymer, polyimide, polyimideamide and a fluoropolymer.

The electroconductive filler may include a carbonaceous filler. An amount of the electroconductive filler may be from about 5 wt % to about 50 wt %. The carbonaceous filler may include at least one of carbon nanotubes, carbon black, carbon nanofiber, graphene, graphite nano platelets and graphite oxide. The resistive heating layer may include about 5 wt % or less metal oxide particles.

The release layer may include at least one of a silicon-based polymer and a fluoropolymer. The fluoropolymer may include at least one of polytetrafluoroethylene, polyperfluoroether, fluorinated polyether, fluorinated polyimide, fluorinated polyether ketone and fluorinated polyamide.

The heating member may further include a support having a hollow pipe shape that supports the resistive heating layer.

The heating member may further include a support having a belt shape that supports the resistive heating layer.

Also provided is a fusing apparatus including: the above-described heating member; and a press member disposed opposing the heat member with respect to a recording medium. The heating member and the press member form a fusing nip for press-transferring the recording medium.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
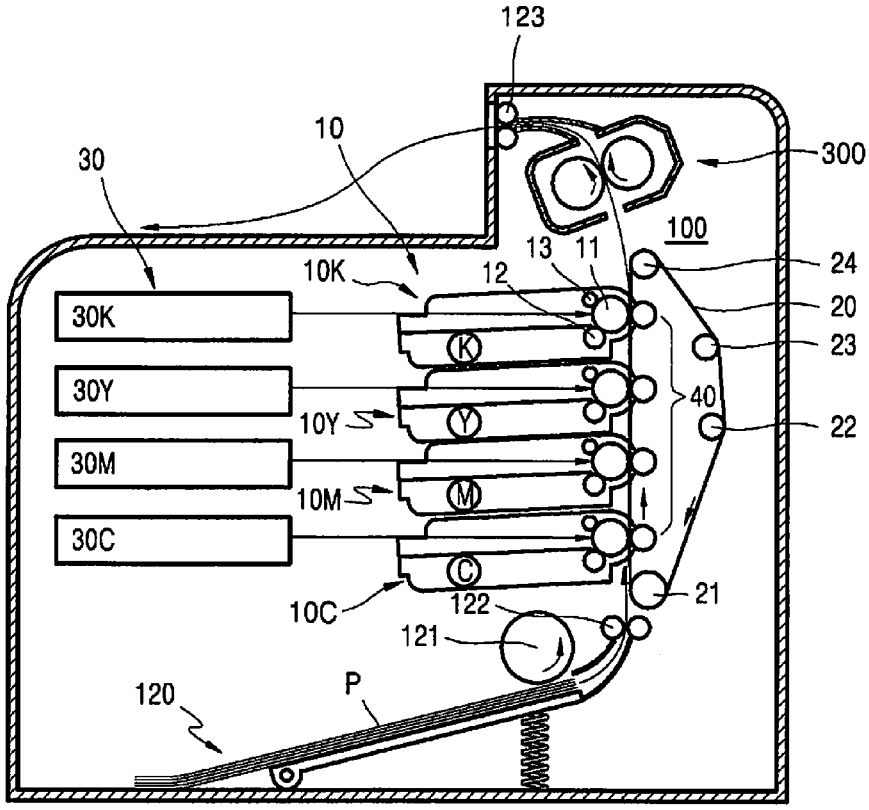
FIG. 1 is a schematic view of a structure of an electrophotographic imaging apparatus including a heating member and a fusing apparatus, according to an embodiment of the present invention.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present invention. As used herein, the term "and/or" includes any and all combinations of one or more of the associated listed items. Expressions such as "at least one of," when preceding a list of elements, modify the entire list of elements and do not modify the individual elements of the list.

It will be understood that when an element or layer is referred to as being "on," "connected to" or "coupled to" another element or layer, the element or layer can be directly on, connected or coupled to another element or layer or intervening elements or layers. In contrast, when an element is referred to as being "directly on," "directly connected to" or "directly coupled to" another element or layer, there are no intervening elements or layers present. As used herein, connected may refer to elements being physically and/or electrically connected to each other.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein. Like numbers refer to like elements throughout. As used herein, the term "and/or" includes any and all combinations of one or more of the associated listed items.

Hereinafter, the invention will be described in detail with reference to the accompanying drawings.

Embodiments of a heating member and a fusing apparatus according to the present invention will now be described more fully with reference to the accompanying drawings, in which exemplary embodiments of the present invention are shown.

FIG. 1 illustrates an embodiment of a structure of an electrophotographic imaging apparatus including a heating member and a fusing apparatus 300 according to the invention disclosure. Referring to FIG. 1, the electrophotographic imaging apparatus includes a printing unit 100 for printing an image on a recording medium through electrophotographic processes, and the fusing apparatus 300. The electrophotographic imaging apparatus of FIG. 1 is a dry type color imaging apparatus for printing a color image using a dry developer (hereinafter, "toner"), but the invention is not limited thereto or thereby.

The printing unit 100 includes an exposing unit 30, a developing unit 10 and a transfer unit. The printing unit 100 may include four developing units 10C, 10M, 10Y, and 10K that respectively accommodate toner of different colors of cyan ("C"), magenta ("M"), yellow ("Y") and black ("K"), and four exposing units 30C, 30M, 30Y and 30K that respectively correspond to the developing units 10C, 10M, 10Y and 10K.

The developing units 10C, 10M, 10Y and 10K each include a photoconductive drum 11 as an image receiver on which is formed an electrostatic latent image, and a developing roller 12 for developing the electrostatic latent image. A charging bias voltage is applied to a charging roller 13 to charge an outer circumferential surface of the photoconductive drum 11 to a uniform potential. A corona charger (not shown) may be used instead of the charging roller 13.

The developing roller 12 supplies toner to the photoconductive drum 11 by attaching the toner on an outer circumferential surface of the developing roller 12. A developing bias voltage for supplying toner to the photoconductive drum 11 is applied to the developing roller 12. Although not illustrated, the developing units 10C, 10M, 10Y and 10K may each further accommodate a supplying roller for attaching toner therein to the developing roller 12, a regulating member for regulating an amount of toner adhered to the developing roller 12, and a stirrer (not shown) for transferring toner therein to the supplying roller and/or the developing roller 12. In other embodiments, although not illustrated, the developing units 10C, 10M, 10Y and 10K may each accommodate a cleaning blade for removing toner adhering to the outer circumference of the photoconductive drum 11 before the photoconductive drum 11 is charged, and a space for receiving the removed toner.

In an embodiment, the transfer unit may include a recording medium conveyer belt 20 and four transfer rollers 40. The recording medium conveyer belt 20 is disposed opposite to the outer circumferential surfaces of the photoconductive drums 11 exposed outside of the developing units 10C, 10M, 10Y and 10K. The recording medium conveyer belt 20 is supported by a plurality of support rollers 21, 22, 23 and 24, and travels in a closed loop. The recording medium conveyer belt 20 may be installed in a vertical direction.

The four transfer rollers 40 are disposed to face the photoconductive drums 11 of the developing units 10C, 10M, 10Y and 10K, respectively, with the recording medium conveyer belt 20 disposed therebetween. A transfer bias voltage is applied to the transfer rollers 40. The exposing units 30C, 30M, 30Y and 30K scan light corresponding to information about images in colors C, M, Y and K onto the photoconductive drums 11 of the developing units 10C, 10M, 10Y and 10K, respectively. The exposing units 30C, 30M, 30Y and 30K may each be a laser scanning unit ("LSI") using a laser diode as a light source, but the invention is not limited thereto or thereby.

An embodiment of method of forming a color image using the electrophotographic imaging apparatus having the above configuration will now be described.

The photoconductive drum 11 of each of the developing units 10C, 10M, 10Y and 10K is charged to a uniform potential by a charging bias voltage applied to the charging roller 13. The four exposing units 30C, 30M, 30Y and 30K scan light corresponding to the information about the images in C, M, Y and K onto the corresponding photoconductive drums 11 of the developing units 10C, 10M, 10Y and 10K to form electrostatic latent images. When a developing bias voltage is applied to each of the developing rollers 12, toner adhering to the outer circumferences of the developing rollers 12 is transferred onto the electrostatic latent images, forming toner images in C, M, Y and K on the photoconductive drums 11 of the developing units 10C, 10M, 10Y and 10K.

A final toner receiving medium, for example, a recording medium P, is drawn out of a cassette 120 by a pickup roller 121, and is then moved onto the recording medium conveyer belt 20 by a feed roller 122. The recording medium P is moved at the same speed as a traveling speed of the recording medium conveyer belt 20 while being adhered to a surface of the recording medium conveyer belt 20 by an electrostatic force.

In one embodiment, for example, a leading end of the recording medium P may reach a transfer nip formed by the photoconductive drum 11 of the developing unit 100 and the corresponding transfer roller 40 at the same time as when a leading end of the toner image in C on the outer circumference of the photoconductive drum 11 of the developing unit 100 reaches the transfer nip. When a transfer bias voltage is applied to the transfer roller 40, the toner image on the photoconductive drum 11 is transferred onto the recording medium P. As the recording medium P is moved, the toner images in M, Y and K on the corresponding photoconductive drums 11 of the developing units 10M, 10Y and 10K are sequentially transferred and overlapped onto the recording medium P, resulting in a color toner image on the recording medium P.

The color toner image transferred on the recording medium P remains on the surface of the recording medium P by an electrostatic force. The fusing apparatus 300 fixes the color toner image to the recording medium P using heat and pressure. The recording medium P to which the color image is fixed is discharged out of the imaging apparatus by a discharge roller 123.

To fix a toner image, the fusing apparatus 300 needs to be heated to approximately a predetermined fusing temperature. The shorter the heating time, the shorter the time that it takes for a first page to be printed out after a printing instruction is received. In electrophotographic imaging apparatuses, normally the fusing apparatus 300 is only heated for printing, and is not operated in a standby mode. The fusing apparatus 300 takes time to be heated again when printing is restarted. To reduce the heating time taken after printing is restarted, the fusing apparatus 300 may be controlled to maintain a predetermined temperature in the standby mode. The preheating temperature of the fusing apparatus 200 in the standby mode may be from about 120 degrees Celsius (° C.) to about 180° C. If it takes a relatively short amount of time to heat the fusing apparatus 300 to a printable temperature, no preheating may be necessary in the standby mode, thus reducing energy consumption in the fusing apparatus 300.

Figure 2:
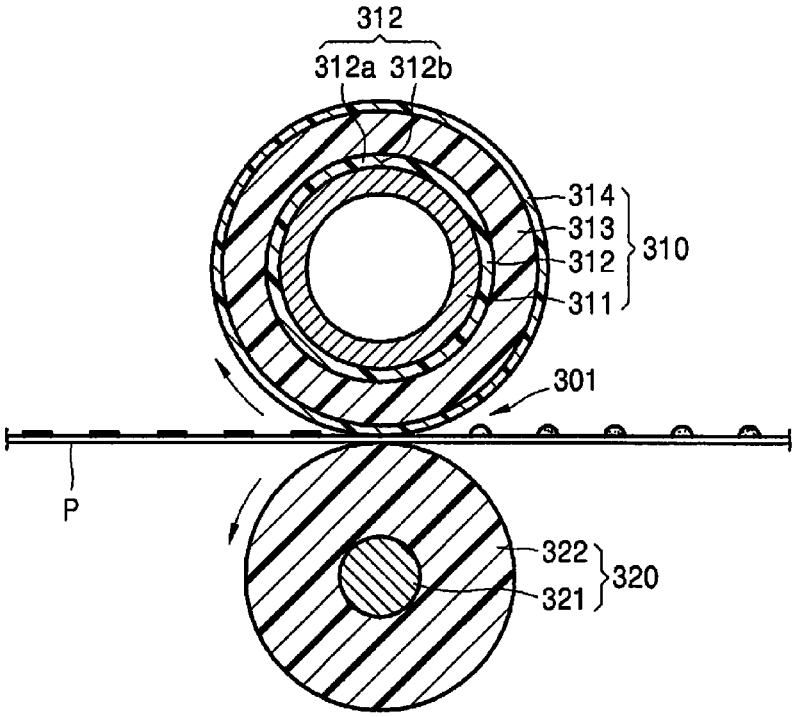
FIG. 2 is a schematic cross-sectional view of a roller type fusing apparatus according to an embodiment of the present invention.
Figure 3:
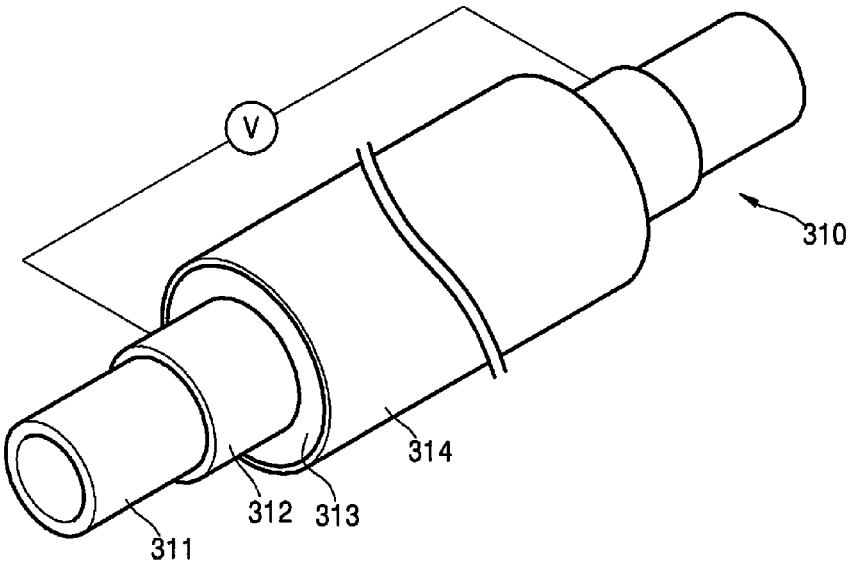
FIG. 3 is a perspective view of a heating member used in the roller type fusing apparatus of FIG. 2, according to an embodiment of the present invention.

FIG. 2 illustrates an embodiment of a structure of a fusing apparatus according to the present invention. FIG. 3 is a perspective view of an embodiment of a heating member according to the present invention. The fusing apparatus of FIG. 2 is of a roller type using a roller-shaped heating member 310.

Referring to FIGS. 2 and 3, the roller-shaped heating member 310 and a press member 320 are disposed opposing each other to form a fusing nip 301. In the present embodiment, the press member 320 may have a roller shape with an elastic layer 322 on a metal support 321. The heating member 310 and the press member 320 are biased to engage with each other by a bias member (not shown), for example, by a spring. As the elastic layer 322 of the press member 320 is partially deformed, the fusing nip 301 for thermal transfer from the heating member 310 to the toner is formed.

The heating member 310 may include a resistive heating layer 312, a support 311 for supporting the resistive heating layer 312, and a release layer 314. An intermediate layer 313 may be further disposed between the resistive heating layer 312 and the release layer 314. The intermediate layer 313 may be an individual and discrete layer between the resistive heating layer 312 and the release layer 314. Due to use of the support 311 having a hollow pipe shape, the heating member 310 may overall have a roller shape. A heating member shaped like the heating member 310 and used in a fusing apparatus of electrophotographic imaging apparatuses is referred to as a fusing roller.

Figure 4:
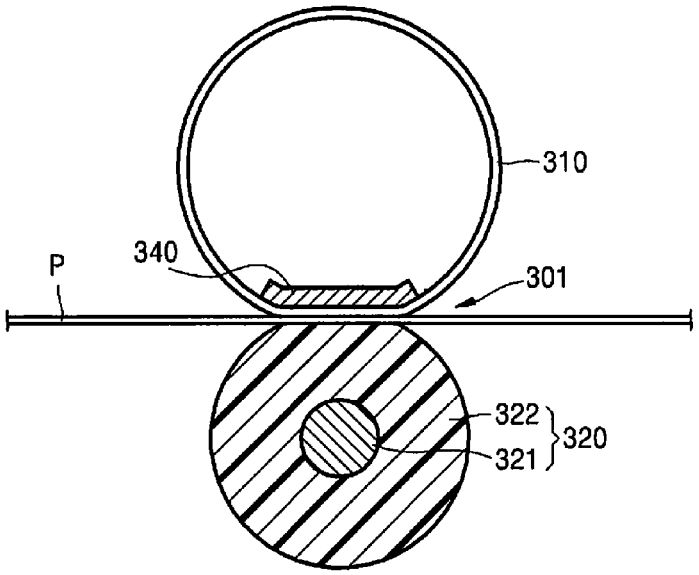
FIG. 4 is a schematic structural view of a belt type fusing apparatus according to another embodiment of the present invention.

FIG. 4 illustrates another embodiment of a structure of a fusing apparatus according to the present invention. The fusing apparatus of FIG. 4 includes a heating member 310 with a belt shaped support 311. This differs from the fusing apparatus of FIG. 2. A heating member shaped like the heating member 310 of FIG. 4 and used in a fusing apparatus is referred to as a fusing belt. Referring to FIG. 4, the heating member 310, a press roller 320 and a nip forming member 340 are illustrated. The nip forming member 340 may be disposed inside the belt-shaped heating member 310 which forms a closed loop. The press member 320 may be disposed outside the fusing member 310. The press member 320 is disposed against the nip forming member 340 with the heating member 310 therebetween and rotates, forming a fusing nip 301. An elastic force may be applied by a bias unit (not shown) to the nip forming member 340 and/or the press roller 320 in a direction in which the nip forming member 340 and the press roller 320 are urged against each other.

Figure 5:
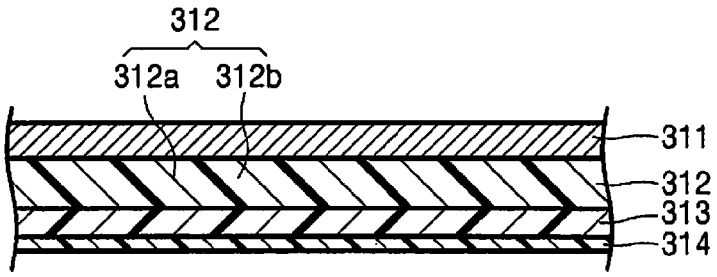
FIG. 5 is a cross-sectional view of a heating member used in the belt type fusing apparatus of FIG. 4, according to an embodiment of the present invention.

Referring to FIG. 5, the heating member 310 may include the belt-shaped support 311, a resistive heating layer 312 disposed on an external surface of the support 311, and a release layer 314. An intermediate layer 313 may be further disposed between the resistive heating layer 312 and the release layer 314. The support 311 may be selected to have sufficient flexibility for free deformation of the heating member 310 at the fusing nip 301 and for recovery to an original state after coming out of the fusing nip 301. In contrast, the support 311 in FIGS. 2 and 3 may be more rigid and less flexible than the support 311 in FIGS. 4 and 5.

In an embodiment, the nip forming member 340 may be pressed toward the press roller 320. The heating member 310 may travel or move with respect to the nip forming member 340 which is statically disposed. Although not illustrated, the nip forming member 340 may have an elastic roller shape, and may travel with respect to the heating member 310 while engaging with the press member 320.

Hereinafter, embodiments of the heating member 310 will be described.

The support 311 may include, but is not limited to, polymer materials, such as polyimide, polyamide-imide and fluoropolymers, and metallic materials. Fluoropolymers may include, but are not limited to, fluorinated polyetherketones ("PEEK"), polytetrafluoroethylenes ("PTFE"), perfluoroalkoxy ("PFA"), and fluorinated ethylene propylene ("FEP"). The metallic materials may include, but are not limited to, stainless steel, nickel, copper and brass. When the support 311 includes a conductive metallic material, an insulating layer (not shown) may be disposed between the support 311 and the resistive heating layer 312.

The resistive heating layer 312 may include a base polymer 312*a*, and an electroconductive filler 312*b* dispersed in the base polymer 312*a*. The base polymer 312*a* may be any of a variety of materials with thermal resistance at a fusing temperature. The base polymer 312*a* may include, but is not limited to, high-thermal durable polymers, such as silicon-based polymer, polyimide, polyamide-imide, and fluoropolymers. Fluoropolymers may include, but are not limited to, PTFE, fluorinated PEEK, PFA and FEP. The resistive heating layer 312 may be elastic. A hardness of the base polymer 312*a* may be adjustable according to a target elasticity of the resistive heating layer 312. The base polymer 312*a* may include at least one of the above-listed polymers, but is not limited thereto or thereby. In one embodiment, for example, the base polymer 312*a* may be one of the above-listed polymers, or may be a blend or a copolymer of more than one of the polymers.

The electroconductive filler 312*b* may include one or more kinds of electroconductive filers dispersed in the base polymer 312*a*. The electroconductive filler 312*b* may include, but is not limited to, a metallic filler such as metal particles, and a carbonaceous filler. Non-limiting examples of the carbonaceous filler are carbon nanotubes ("CNT"), carbon black, carbon nanofiber, graphene, expanded graphite, graphite nano platelet and graphite oxide ("GO").

The electroconductive filler 312*b* may be dispersed in the base polymer 312*a*, forming an electroconductive network. In one embodiment, for example, a conductor or a resistor having a conductivity of about $10^{-4}$ siemens per meter (S/m) to about 100 S/m may be formed depending on the amount of carbon nanotubes used. Referring to Table 1 below, carbon nanotubes have a relatively low density with a conductivity similar to that of metals, and thus has a thermal capacity (thermal capacity=density×specific heat) per unit volume about three to four times lower than those of other resistive materials. This indicates that the resistive heating layer 312 including carbon nanotubes as the electroconductive filler 312*b* may be able to undergo rapid temperature changes. Thus, use of the heating member 310 with the resistive heating layer 312 including the electroconductive filler 312*b* may reduce the time taken to switch from a standby mode to a printing mode, enabling rapid printing from the beginning. Furthermore, there is almost no need to preheat the heating member 310 in the standby mode, and thus power consumption may be reduced.

TABLE 1

| Resistive material | Density in grams per cubic centimeter ($g/cm^3$) | Specific resistance in ohms centimeter (Ω cm) | Thermal conductivity (W/m · K) | Specific heat in joules per kilogram per Kelvin (J/Kg · K) |
|---|---|---|---|---|
| $Al_2O_3$ | 3.97 | $>10^{14}$ | 36 | 765 |
| AlN | 3.26 | $>10^{14}$ | 140~180 | 740 |
| Stainless steel | 7.8 | $>10^{-5}$ | 55 | 460 |
| Silicon (polydimethylsiloxane, PDMS) | 1.03 | $>10^{14}$ | 0.18 | 1460 |
| Carbon nanotubes | ~1.35 | $\sim10^{-3}\sim10^{-4}$ | >3000 | 700 |
| Nichrome wire | 8.4 | $1.09 \times 10^{-4}$ | 11.3 | 450 |

An amount of the carbonaceous filler may be from about 5 wt % to about 50 wt %. If the amount of the carbonaceous filler is less than about 5 wt %, formation of an effective electroconductive network is substantially not possible. The larger the amount of the carbonaceous filler in the resistive heating layer 312, the higher the electric conductivity becomes, but the resistive heating layer 312 may become relatively stiff. The resistive heating layer 312 may form the fusing nip 301 along with the press member 320. However, if the resistive heating layer 312 becomes relatively stiff, this may be disadvantageous in forming a sufficiently large fusing nip 301. If the resistive heating layer 312 has a relatively high stiffness, mechanical characteristics thereof may be deteriorated, and thus the heating member 310 may have a relatively short lifespan. In view of this, the amount of the carbonaceous filler may be about 50 wt % or less. To improve thermal resistance of the resistive heating layer 312, the resistive heating layer 312 may include, for example, metal oxide particles, such as $Fe_2O_3$, $Al_2O_3$ and the like. An amount of the metal oxide particles may be, for example, about 5 wt % or less.

The release layer 314 forms an outermost layer of the heating member 310. In a fusing process, toner on the recording medium P may melt and adhere to the heating member 310, causing an offset. This offset may be a cause of poor printing with partial loss of a printed image on the recording medium P, and a jam of the recording medium P, e.g., sticking of the recording medium P traveling out of the fusing nip 301 to a surface of the heating member 310. To prevent toner from adhering to the heating member 310, the release layer 314 may include an easy-releasable polymer layer.

The release layer 314 may include, for example, a silicon-based polymer and a fluoropolymer. Non-limiting examples of the fluoropolymer are polyperfluoroethers, fluorinated polyethers, fluorinated polyimides, fluorinated PEEK, fluorinated polyamides and fluorinated polyesters. The release layer 314 may include one of the above-listed polymers, a hybrid of more than one, or a copolymer of more than one.

When the release layer 314 is bound to the resistive heating layer 312, a primer may be applied to between an external surface of the resistive heating layer 312 and the release layer 314. In one embodiment, for example, the release layer 314 to which the primer is applied may be bound to the external surface of the resistive heating layer 312. The higher the electrical conductivity of the resistive heating layer 312, the more rapid the temperature increases. To this end, the amount of the electroconductive filler 312*b* may be increased as much as possible within the above-described range. The primer may bind the base polymer 312*a* of the resistive heating layer 312 and the release layer 314, but may not bind the electroconductive filler 312*b* and the release layer 314. Thus, if the amount of the electroconductive filler 312*b* is increased, a larger amount of the electroconductive filler 312*b* is exposed to the external surface of the resistive heating layer 312. This may weaken the binding strength between the release layer 314 and the resistive heating layer 312.

Figure 6:
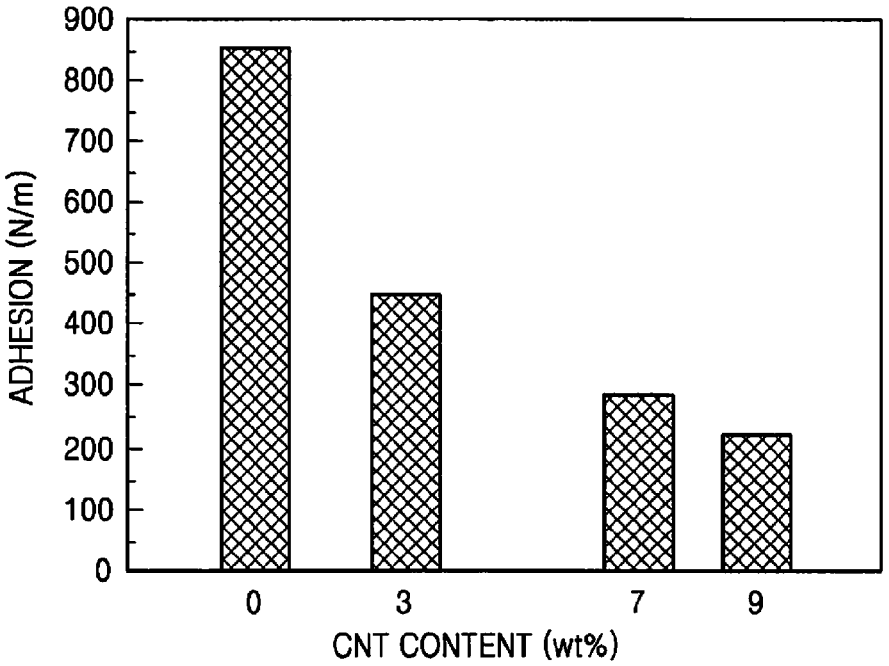
FIG. 6 is a graph of adhesion in units of newtons per meter (N/m) with respect to content of carbon nanotubes ("CNT") in units of weight percent (wt %), in an adhesive heating layer.

FIG. 6 is a graph of an adhesion test result showing adhesion in units of newtons per meter (N/m) with respect to content of carbon nanotubes ("CNT") in units of weight percent (wt %). The carbon nanotubes are the electroconductive filler 312*b* dispersed in a silicone elastomer as the base layer 312*a* of the resistive heating layer 312, bound with the release layer 314 formed of a fluoropolymer. In the embodiment represented in FIG. 6, for example, the heating member 310 is formed as a belt type by binding the release layer 314 to which the primer is applied to the external surface of the resistive heating layer 312, and then by curing the resultant bound structure at about 150° C. for about 30 minutes and then at about 200° C. for 4 hours. A peel test at 90 degrees was performed to measure adhesion between the resistive heating layer 312 and the release layer 314.

Referring to FIG. 6, the greater the content of the carbon nanotubes, the smaller the adhesion becomes. In consideration that a maximum pressure exerted on a fusing nip 301 of a fusing apparatus is about 10 megapascals (MPa), a peel strength of the release layer 314 needs to be about 300 N/m or greater. However, when the content of carbon nanotubes is about 5 wt % or greater, the peel strength becomes lower than about 300 N/m. In consideration that the content of the electroconductive filler 312*b* in the resistive heating layer 312 is about 5 wt % or greater, implementation of a highly durable fusing apparatus with the structure in which the release layer 314 and the resistive heating layer 312 are directly bound together is difficult. If the resistive heating layer 312 and the release layer 314 do not form a smooth binding interface, a pin hole may result in the interface between the resistive heating layer 312 and the release layer 314. This pin hole may lower a withstand voltage, and further damage the release layer 314. If the release layer 314 is damaged, there is a risk of an electric shock due to a leakage current.

In the present embodiment, the heating member 310 may include the intermediate layer 313 further between the resistive heating layer 312 and the release layer 314. A polymer material being a same type as the base polymer 312*a* included in the resistive heating layer 312 may be used for a polymer in the intermediate layer 313. This may improve the adhesion between the intermediate layer 313 and the resistive heating layer 312, since adhesion between the same type polymer materials is greater compared with that of different type polymer materials.

The intermediate layer 313 may include a polymer layer. The polymer layer may include at least one of a silicon-based polymer and a fluoropolymer, or a hybrid or copolymer thereof. Non-limiting examples of the fluoropolymer are polyperfluoroethers, fluorinated polyethers, fluorinated polyimides, fluorinated PEEK, fluorinated polyamides and fluorinated polyesters.

The intermediate layer 313 may be substantially a non-electroconductive layer. That is, the intermediate layer 313 may be a layer not including any substantial amount of electroconductive filler. In one embodiment, a small amount of the electroconductive filler may be included, intentionally or unintentionally, in the intermediate layer 313 in an amount less than about 5 wt %.

In one embodiment of a method of forming the heating member 310, for example, the electroconductive filler 312*b* may be dispersed in the base polymer 312*a* to form the resistive heating layer 312. The intermediate layer 313 may be formed on a surface of the formed resistive heating layer 312 using a polymer material being a same type as the base polymer 312*a* of the resistive heating layer 312. The intermediate layer 313 may be formed on the external surface of the resistive heating layer 312 prior to curing the resistive heating layer 312, and then the resistive heating layer 312 and the intermediate layer 313 may be cured together, thereby further improving the adhesion. In some embodiments, to reduce or effectively prevent damage of the resistive heating layer 312 in forming the intermediate layer 313, the intermediate layer 313 may be formed after the resistive heating layer 312 is half-cured. The forming the intermediate layer 313 after the resistive heating layer 312 is half-cured may also improve the adhesion between the resistive heating layer 312 and the intermediate layer 313.

Thereafter, the release layer 314 including a primer thereon may be bound to an external surface of the formed intermediate layer 313. Since the intermediate layer 313 includes none or substantially no electroconductive filler by including a small amount of the electroconductive filler, a smooth, high-adhesive interface may be formed between the intermediate layer 313 and the release layer 314, and thus the adhesion between the intermediate layer 313 and the release layer 314 may be improved.

Figure 7:
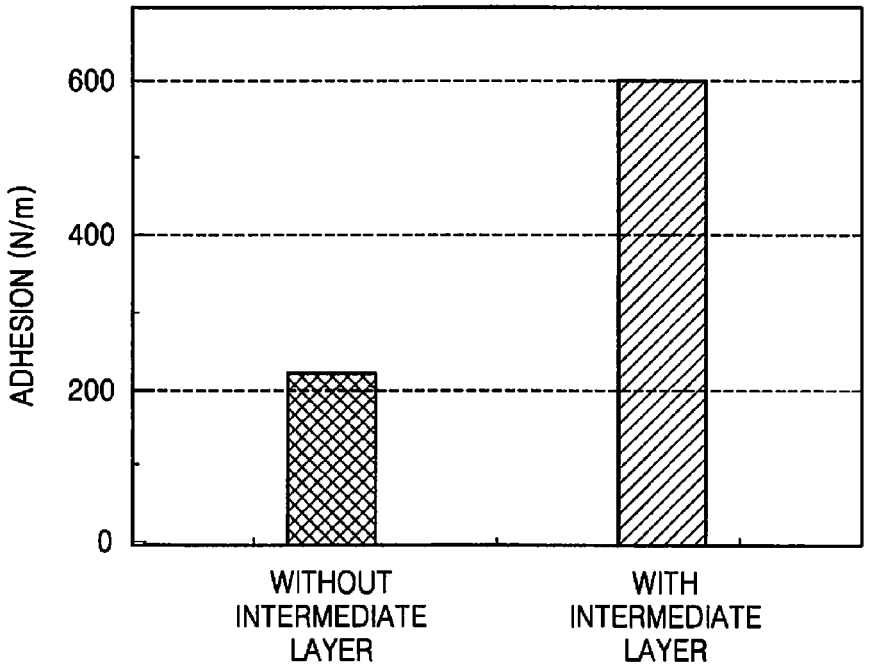
FIG. 7 is a graph comparing adhesion in units of N/m with respect to the absence or presence of an intermediate layer.

In one embodiment, for example, after forming the resistive heating layer 312 to have a thickness of 300 microns (μm) using a dispersion of 9 wt % of carbon nanotubes in silicon rubber, and forming the intermediate layer 313 to have a thickness of 50 μm using silicon rubber including no carbon nanotubes on the external surface of the resistive heating layer 312, the release layer 314 may be formed using a fluoropolymer on the external surface of the intermediate layer 313. A 90-degree peel test was performed on the heating member 310 formed through the above processes to measure adhesion. The results are shown in FIG. 7. Referring to FIG. 7, the heating member 310 is found to have a greater peel strength due to the higher adhesion, when the heating member 310 includes the intermediate layer 313 as compared with when the heating member 310 excludes the intermediate layer 313.

The intermediate layer 313 is an elastic polymer layer, and thus may serve as an elastic layer along with the resistive heating layer 312. This facilitates formation of the fusing nip 301, improving fusing characteristics. Further, a degree of fatigue with repeated use may be reduced, and thus durability of the heating member 310 may be improved.

Figure 8:
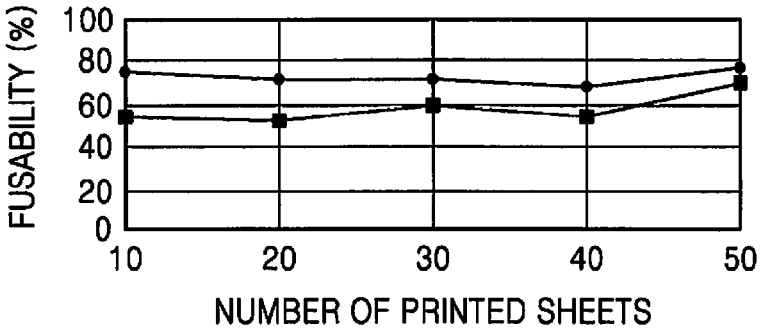
FIG. 8 is a graph of fusibility in units of percent (%) with respect to a number of printed sheets, without an intermediate layer.
Figure 9:
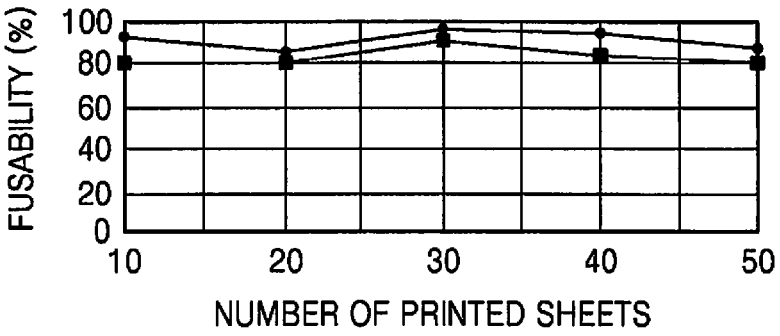
FIG. 9 is a graph of fusibility in units of % with respect to a number of printed sheets, with an intermediate layer.

FIGS. 8 and 9 are graphs of results of a fusibility test performed on a heating member with the intermediate layer 313 and on a heating member without the intermediate layer 313 at a fusing temperature of about 180° C. and a pressure of about 15 kilogram force (Kgf). The belt type heating member 310 with the resistive heating layer 312, the intermediate layer 313 and the release layer 314 disposed on the polyimide support 311 having a thickness of 50 μm was used for the fusibility test. The resistive heating layer 312 formed of silicon rubber including about 10 wt % of carbon nanotubes dispersed therein had a thickness of about 250 μm. The intermediate layer 313 formed of silicon rubber without carbon nanotubes had a thickness of about 100 μm. The release layer 314 as a PFA layer had a thickness of about 30 μm.

FIG. 8 is a graph of fusibility in units of percent (%) with respect to a number of printed sheets, without an intermediate layer. FIG. 9 is a graph of fusibility in units of % with respect to a number of printed sheets, with an intermediate layer. Referring to FIGS. 8 and 9, when the heating member includes the intermediate layer 313, fusibility is maintained at about 80% or greater even with an increasing number of printed sheets, indicating an improvement as compared with when the heating member does not include the intermediate layer.

The intermediate layer 313 may also improve a voltage withstood or tolerated by the heating member 310. The withstood voltage increases in proportion to the thickness of a current cutoff material. The inclusion of the non-electroconductive intermediate layer 313 between the resistive heating layer 312 and the release layer 314 may contribute to increasing the thickness of the cutoff material.

When used in a fusing apparatus, the heating member 310 needs to withstand a voltage of about 4 kilovolts (kV) or greater. In considering that the release layer 314 including a fluoropolymer withstands a voltage of about 100 volts per micron (V/μm) and has a thickness of about 30 μm, the release layer 314 may withstand about 3 kV. Since the heating member 310 needs to withstand a voltage of about 4 kV or greater, the intermediate layer 313 may be formed to withstand a voltage of about 1 kV.

To also serve as an elastic layer, the intermediate layer 313 may have a larger thickness than the release layer 314. The intermediate layer 313 may have to withstand voltage of about 50 V/μm or greater.

The intermediate layer 313 as a non-electroconductive layer may block leakage current. The intermediate layer 313 may prohibit external growth of pinholes in the interface between the resistive heating layer 312 and the intermediate layer 313, thereby blocking leakage current. Even with damage of the release layer 314 due to repeated use, the resistive heating layer 312 may not be externally exposed due to the non-electroconductive intermediate layer 313 covering the resistive heating layer 312. Thus, an electric shock caused by leakage current may be reduced or effectively prevented.

The intermediate layer 313 may include a polymer with an inflammability grade of V2 or higher, according to Underwriters Laboratories standard UL94. The covering of the resistive heating layer 312 with the inflammable intermediate layer 313 is conducive to rendering the entire fusing apparatus inflammable.

The intermediate layer 313 may have thermal conductivity effective in transferring heat generated in the resistive heating layer 312 to the fusing nip 301. To this end, the intermediate layer 313 may have a thermal conductivity of about 0.5 W/m·K or greater. To improve the thermal conducting characteristics of the intermediate layer 313, about 30 wt % or greater of thermal conducting particles of, for example, alumina ($Al_2O_3$), zinc oxide, metal silicon or the like, may be included in the intermediate layer 313.

Although in the above embodiments the intermediate layer 313 is described as including a polymer material being a same type as a polymer material used in the resistive heating layer 312, the present invention is not limited thereto. In other embodiments, the intermediate layer 313 may include a polymer material being a same type as a polymer-material used in the release layer 314. A highly adhesive interface may be formed between the intermediate layer 313 and the release layer 314 to have a peel strength of about 300 N/m or greater.

Since the intermediate layer 313 may serve as an elastic layer along with the resistive heating layer 312, a degree of fatigue of the resistive heating layer 312 accumulating with repeated use may be reduced. Thus, the heating member 310 may have improved durability. The intermediate layer 313 disposed between the resistive heating layer 312 and the release layer 314 may prohibit external growth of pinholes in the interface between the resistive heating layer 312 and the intermediate layer 313, thereby reducing or effectively preventing damage of the release layer 314 and generation of leakage current.

Figure 10:
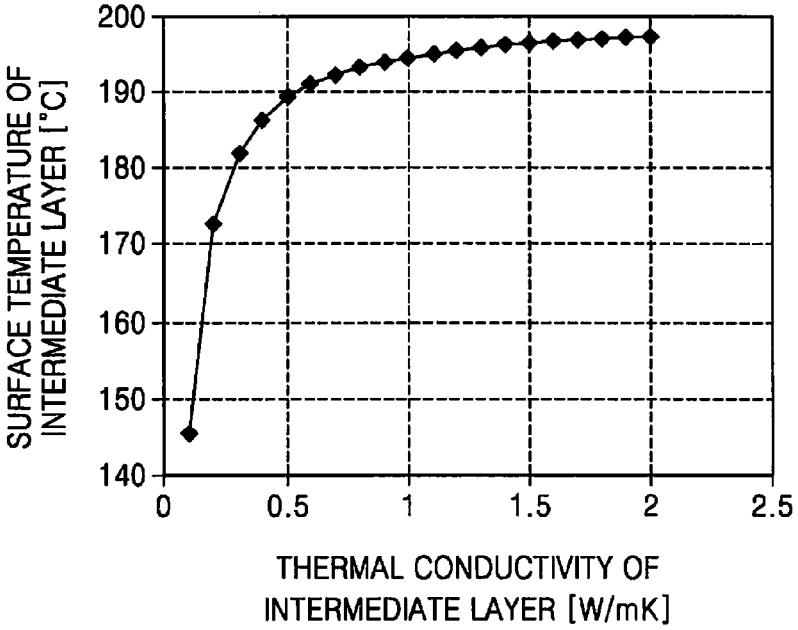
FIG. 10 is a simulation graph of surface temperature in units of degrees Celsius (° C.) of an intermediate layer with respect to thermal conductivity thereof in units of watts per meter per Kelvin (W/m·k) when a resistive heating layer has a constant surface temperature.

FIG. 10 is a simulation graph of surface temperature in units of ° C. of the intermediate layer 313 with respect to thermal conductivity thereof in units of W/m·k when the resistive heating layer 312 has a constant surface temperature. In the simulation test, it is assumed that the surface temperature of the resistive heating layer 312, i.e., the interfacial temperature of the resistive heating layer 312 and the intermediate layer 313, is about 200° C., the thickness of the intermediate layer 313 is about 200 μm, and energy for printing is about 1000 watts (W). Furthermore, the release layer 314 is not considered. Referring to FIG. 10, the greater the thermal conductivity of the intermediate layer 313, the higher the surface temperature of the intermediate layer 313 becomes. This is conducive to improving fusing characteristics.

Figure 11:
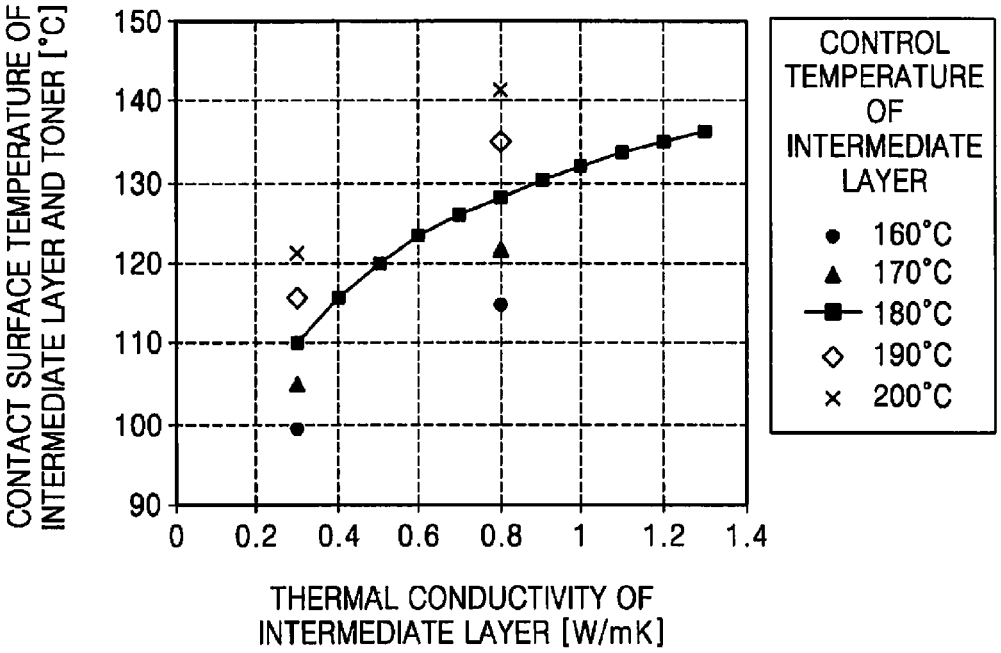
FIG. 11 is a simulation graph of toner fusibility expressed as a contact surface temperature of an intermediate layer in units of ° C. with respect to thermal conductivity of the intermediate layer.

FIG. 11 is a simulation graph of toner fusibility with respect to thermal conductivity of the intermediate layer 313. In this simulation test, it is assumed that the release layer 314 is not formed and the intermediate layer 313 directly contacts toner. Furthermore, the intermediate layer 313 is assumed to have a density of about 1000 kilograms per cubic meter ($kg/m^3$) and a thermal capacity of about 1000 J/Kg·K. In FIG. 11, the horizontal axis indicates thermal conductivity in units of W/m·k of the intermediate layer 313, and the vertical axis indicates a temperature in units of ° C. of a surface of the intermediate layer 313 contacting toner. When the toner temperature is room temperature (about 25° C.), and the temperature of the intermediate layer 313 is controlled to be about 180° C., increasing the thermal conductivity of the intermediate layer 313 from about 0.3 W/m·K to about 0.8 W/m·K provides an effect of an increase in a contact surface temperature of about 20° C., for example, from about 110° C. to about 130° C. Therefore, according to the present invention, if the intermediate layer 313 has a high thermal conductivity, fusibility of the toner may be improved.

As described above, although the one or more of the above embodiments of the present invention are described with reference to the use of the heating member in a fusing apparatus of an electrophotographic imaging apparatus, the application of the heating member is not limited only to the fusing apparatus, and for example, the heating member may apply in any of a variety of apparatuses generating heat from electricity.

It should be understood that the embodiments described herein should be considered in a descriptive sense only and not for purposes of limitation. Descriptions of features or aspects within each embodiment should typically be considered as available for other similar features or aspects in other embodiments.

What is claimed is:

1. A heating member comprising:

a resistive heating layer which generates heat when electrical energy is supplied thereto, the resistive heating layer comprising:

a base polymer; and an electroconductive filler which is dispersed in the base polymer;

a release layer as an outermost layer of the heating member and comprising a polymer; and an intermediate layer between the resistive heating layer and the release layer, and comprising polymer material being a same type as the base polymer of the resistive heating layer or the polymer of the release layer.

2. The heating member of claim 1, wherein the intermediate layer is an elastic layer.

3. The heating member of claim 1, wherein adhesion between the intermediate layer and the release layer is about 300 N/m or greater.

4. The heating member of claim 1, wherein the intermediate layer has a thermal conductivity of about 0.5 W/m·K or greater.

5. The heating member of claim 1, wherein the intermediate layer comprises about 30 wt % or more of thermal conducting particles, and the thermal conducting particles comprise at least one of alumina, zinc oxide and metal silicon.

6. The heating member of claim 1, wherein the intermediate layer is substantially a non-electroconductive layer.

7. The heating member of claim 1, wherein the intermediate layer comprises at least one of a silicon-based polymer and a fluoropolymer.

8. The heating member of claim 1, wherein the base polymer of the resistive heating layer comprises at least one of a silicon-based polymer, polyimide, polyimideamide and a fluoropolymer.

9. The heating member of claim 8, wherein the electroconductive filler of the resistive heating layer comprises a carbonaceous filler.

10. The heating member of claim 8, wherein an amount of the electroconductive filler is from about 5 wt % to about 50 wt %.

11. The heating member of claim 9, wherein the carbonaceous filler comprises at least one of carbon nanotubes, carbon black, carbon nanofiber, graphene, graphite nano platelets and graphite oxide.

12. The heating member of claim 7, wherein the resistive heating layer comprises about 5 wt % or less metal oxide particles.

13. The heating member of claim 1, wherein the release layer comprises at least one of a silicon-based polymer and a fluoropolymer.

14. The heating member of claim 13, wherein the fluoropolymer comprises at least one of polytetrafluoroethylene, polyperfluoroether, fluorinated polyether, fluorinated polyimide, fluorinated polyether ketone and fluorinated polyamide.

15. The heating member of claim 1, further comprising a hollow pipe-shaped support which supports the resistive heating layer.

16. The heating member of claim 1, further comprising a belt-shaped support which supports the resistive heating layer.

17. A fusing apparatus comprising:

a heating member; and a press member opposing the heat member with respect to a recording medium, wherein the heating member and the press member form a fusing nip, and the heating member comprises:

a resistive heating layer which generates heat when electrical energy is supplied thereto, the resistive heating layer comprising:

a base polymer; and an electroconductive filler which is dispersed in the base polymer;

a release layer as an outermost layer of the heating member and comprising a polymer; and an intermediate layer between the resistive heating layer and the release layer, and comprising a polymer material being a same type as the base polymer of the resistive heating layer or the polymer of the release layer.

18. The fusing apparatus of claim 17, further comprising a hollow pipe-shaped support which supports the resistive heating layer.

19. The fusing apparatus of claim 17, further comprising a belt-shaped support which supports the resistive heating layer.

20. The fusing apparatus of claim 17, wherein the intermediate layer comprises at least one of a silicon-based polymer and a fluoropolymer.

21. The fusing apparatus of claim 17, wherein the fluoropolymer comprises at least one of polytetrafluoroethylene, polyperfluoroether, fluorinated polyether, fluorinated polyimide, fluorinated polyether ketone and fluorinated polyamide.

22. The fusing apparatus of claim 17, wherein the electroconductive filler comprises about 5 wt % to about 50 wt % carbonaceous filler.

* * * * *